United States Patent [19]

Lukes et al.

[11] 4,007,037

[45] Feb. 8, 1977

[54] COMPOSITION AND METHOD FOR CHEMICALLY ETCHING COPPER ELEMENTS

[75] Inventors: Robert M. Lukes, Louisville; Jeffrey C. Sellins, Douglass Hills, both of Ky.

[73] Assignee: General Electric Company, Louisville, Ky.

[22] Filed: July 9, 1975

[21] Appl. No.: 594,312

[52] U.S. Cl. ..... 75/117; 156/642; 156/666; 252/79.2; 252/79.3; 252/79.4; 423/35

[51] Int. Cl.[2] ..... C22B 15/12

[58] Field of Search ..... 156/18, 19; 252/79.1, 252/79.2, 79.3, 79.4; 75/109, 117; 423/35

[56] References Cited

UNITED STATES PATENTS

| | | | |
|---|---|---|---|
| 2,908,557 | 10/1959 | Black et al. | 156/19 |
| 3,367,875 | 2/1968 | Sherer et al. | 252/79.4 |
| 3,772,105 | 11/1973 | Shipley | 156/19 |
| 3,816,306 | 6/1976 | Roy | 423/35 |

*Primary Examiner*—Charles E. Van Horn
*Assistant Examiner*—Jerome W. Massie
*Attorney, Agent, or Firm*—Francis H. Boos

[57] ABSTRACT

This invention resides in compositions and methods for chemically etching copper elements. The etching solution of this invention is composed of materials which can be easily regenerated and the copper metal etched from the copper element easily recovered. The etching solution is also of a type that is substantially self-sustaining.

25 Claims, No Drawings

COMPOSITION AND METHOD FOR CHEMICALLY ETCHING COPPER ELEMENTS

BACKGROUND OF THE INVENTION

Solutions of cupric ions and complexing agents have been used to dissolve metal, especially copper and copper alloys. This is desirable, for example, in place of ordinary machining for removing specified amounts of these metals from surfaces of fragile or peculiarly shaped objects. A wide-spread application of this technique is the production of printed electrical circuits. In this application, a resist or mask in the form of the desired circuit is placed over a copper film laminated to a base, and the partially masked copper film is placed in contact with an etchant. The copper surface not covered by the resist is dissolved while the copper covered by the resist remains to form the desired circuit pattern.

One such cupric etchant is the well known, highly acidic cupric chloride etchant dissolved in hydrochloric acid. Another etching solution is disclosed in U.S. Pat. No. 3,231,503. This patent teaches a primary etchant solution of a chlorite such as sodium chlorite in an alkaline solution containing an ammonium salt complexing agent for the metal stripped. The etchant is used at a pH of from 8 to 13, preferably above pH 9. It is disclosed in said patent that the useful life of the etchant can be extended upon exhaustion of the primary oxidant, i.e., the chlorite, by increasing temperature to utilize dissolved copper in the cupric state as a secondary oxidant for further dissolution of copper converting the cupric copper to the cuprous form in the process. Accordingly, at this stage of the etching operation, the etchant solution is a cupric ion-ammoniacal etchant comprising an ammonia-containing solution of cupric chloride as the oxidant having a pH between about 9 and 13. The ammonia is the complexing agent holding both cupric and cuprous ions in solution.

An improved cupric-ion-type etchant is disclosed in U.S. Pat. No. 3,650,958. This etchant essentially comprises cupric ions and a non-fuming complexing agent to maintain said cupric ions and dissolved copper in solution, preferably an amine complexing agent capable of forming a solution soluble copper (II) complex and, preferably, a source of chloride or bromide ions.

Though capable of operating within a broad range of pH, dependent upon the selection of the complexing agent, the etchant is preferably an essentially neutral etchant operating within a pH range of 7 to 8. The etchants treated herein are believed to be an improvement over those of the afore-said U.S. Pat. No. 3,231,503 because they are non-fuming, thereby avoiding noxious fumes and, in addition, have the capacity of operating within the preferred pH range of 7 to 8 at which range they do not attack materials used in the manufacture of printed circuit boards such as resins and the like.

In use of the aforesaid etchants, the copper is dissolved by one mole of the cupric ion oxidizing one mole of elemental copper to form two moles of cuprous ion. For this to occur, it is essential that an ion or compound which forms a stable complex ion with cuprous ion be present in the solution. This complexing action effectively reduces the concentration of free cuprous ion in the solution to a level low enough to avoid precipitation of cuprous oxide or the disproportionation of cuprous ion back into cupric ion and free copper. The latter reaction, the disproportionation, is intrinsic to the well-known equilibrium between copper metal, cupric ion and cuprous ion. The equilibrium is such that it effectively prevents dissolution of copper metal by cupric ion to form cuprous ion unless the free cuprous ion in solution is maintained at a very low concentration. Examples of complexing agents that have been used to perform the desired function are chloride and cyanide ions and ammonia. These materials also are capable of forming stable complex ions with cupric ion.

The dissolution continues until the rate decreases to an unacceptable commercial level due to low cupric ion concentration, saturation with dissolved copper, and insufficient complexing agent. As a result of high concentration of copper, in some instances, copper begins to precipitate from solution in the form of a salt or an oxide or hydroxide of copper. If the copper is left in the etchant, etching would stop and the etching equipment would become clogged by the heavy, somewhat gelatinous precipitate.

The spent etchant, as described above, cannot be readily discarded because of strict code regulations prohibiting the dumping of materials which adversely affect the ecology. The dumping of copper, as an example, is generally prohibited. Moreover, dumping of the spent etchant is also economically undesirable because the etchant contains materials that have intrinsic value. For example, copper dissolved in solution has value as scrap metal or as a raw material for preparation of fresh etchant. The complexing agent for the copper is also of value and it would be highly desirable to recover and/or reuse this material.

Various methods have been proposed for treatment of spent etchant. For example, it has been proposed to vaporize the water and collect the solids. However, this method is uneconomical and the recovered solids have to be further treated to recover their components in useful form. A further method proposed in the prior art for treating spent etchant of the ammonium persulphate type, rather than the type treated by the process disclosed herein, comprises electroplating all copper from solution. This method is generally unacceptable because it has for an object removal of all copper to permit dumping. The cost of removing the last remaining parts of copper from solution is expensive and time consuming. Furthermore, the remaining persulphate may be destroyed to a degree by the process, thereby preventing full utilization of the remaining oxidant.

SUMMARY OF THE INVENTION

In accordance with this invention, an aqueous copper etching solution comprises a water solution of a cupric compound into which is mixed a complexing agent. The cupric compound is water soluble and substantially free of anions capable of forming a stable complex ion with cuprous ions in the solution. The complexing agent is a material capable of forming a stable complex ion with cuprous ions and is substantially free of material capable of forming a complex ion with cupric ion.

In the copper etching process of this invention, a copper element to be etched is contacted with said copper etching solution. The etching solution and copper element are maintained in contact with one another under etching conditions for a time sufficient to etch said copper element and form a cuprous complex.

DETAILED DESCRIPTION OF THE INVENTION

The aqueous copper etching solution of this invention is comprised of water, a cupric compound and a complexing agent. The copper etching solution can contain a wetting agent for improving etching. The wetting agent can be, for example, sodium lauryl sulfate, a fatty alcohol-ethylene oxide condensate, a propylene glycol-ethylene oxide condensate, and the like. The etching solution and process of this invention can be used for chemically etching plates or sheets for forming printed wiring boards for electric or electronic circuitry, or for chemically etching any other copper element.

With reference to the cupric compound of the copper etching solution, it is necessary that said cupric compound be water soluble and substantially free of anions capable of forming a stable complex ion with cuprous ions in said copper etching solution. Cupric compounds that can be used in this invention are, for example, cupric sulphate, cupric sulfamate, cupric nitrate, cupric fluosilicate, cupric acetate, cupric formate, or mixtures thereof, among others.

With reference to the complexing agent of the copper etching solution, it is not necessary that said complexing agent be water soluble, but it is necessary that said complexing agent be a material that is capable of forming a stable complex ion with cuprous ions and that it be substantially free of material capable of forming a complex ion with cupric ions.

Complexing agents that can be used in this invention are, for example, carbon monoxide, ethylene, and derivatives of ethylene having the formula

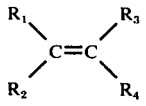

where $R_1$, $R_2$ and $R_3$ are each one of hydrogen or methyl, and $R_4$ is a member of the group consisting of H, $-CH_2OH$, $-CH(C_2H_5)OH$, $-CH(CH_3)OH$, $-C(CH_3)_2OH$, $-CH_2CH_2OH$, $-CH_2CH(CH_3)OH$, and $-CH_2C(CH_3)_2OH$. Materials that can be used as a complexing agent in this invention include carbon monoxide, ethylene, propylene, allyl alcohol, crotyl alcohol, 1-methylallyl alcohol, 2-methylallyl alcohol, ethylvinylcarbinol, $\alpha,\alpha$-dimethylallyl alcohol, 4-methyl-4-penten-2-ol, $\gamma,\gamma$-dimethylallyl alcohol, 3-methyl-3-buten-2-ol, 2-methyl-2-buten-2-ol, or mixtures thereof, among others.

Cupric compounds which are not water soluble are undesirable because they do not provide a concentration of cupric ions in solution sufficient to provide a desirable rate of etching or a desirable etching capacity. Cupric compounds which have anions capable of complexing cuprous ions in said copper etching solution, such as cupric chloride or cupric cyanide, for example, are undesirable because no convenient means is known for treating the cuprous ion complex and physically removing the resultant anion from the solution. Complexing agents which do not form a stable complex ion with cuprous ions are undesirable because they do not reduce the concentration of free cuprous ion to a sufficiently low level for the continuation of the etching process. Complexing agents which form a complex ion with cupric ions are undesirable because there would be an undesirable competition between cuprous ion and cupric ion for the complexing agent.

Therefore, by so formulating a copper etching solution which has the limitations and characteristics as set forth above and further discussed hereinafter, said solution can be utilized to etch a copper element while providing an efficient process for removing the copper metal etched from the element and regenerating the etching solution for further use. The efficiency of the copper metal separation and etching solution regeneration result from reductions in the number of treating steps, the number of chemicals utilized, power utilized, the savings realized from the value of etched copper metal recovered, the value of the chemicals of the subject etching solution, and/or the reduction of disposal costs, relative to heretofore utilized chemical copper etching solutions and processes.

The copper etching solution of this invention has a cupric compound concentration in the range of about 0.1 to about 5.0 molar, preferably in the range of about 1 to about 3 molar. Cupric compound concentrations less than about 0.1 molar are undesirable because the etching rate would be undesirably low. Cupric compound concentrations greater than about 5.0 molar are undesirable because solutions of such concentration are difficult to maintain without undesirable precipitants that can clog and foul equipment.

The copper etching solution of this invention has a pH in the range of about 0 to about 7. A pH of the copper etching solution greater than about 7 is undesirable because at such pH levels an undesirable precipitation of cupric hydroxide occurs. Sulfuric acid, nitric acid, fluosilicic acid, acetic acid, formic acid, sulfamic acid, or mixtures thereof, can be added to the etching solution for maintaining the pH of the etching solution in the preselected range.

In the method of this invention, a copper element to be chemically etched is contacted with the aqueous etching solution of this invention. The etching solution is maintained in contact with the copper element under etching conditions for a period of time sufficient to etch the copper element and form a cuprous complex.

In the copper etching method of this invention, it is believed that preselected portions of the copper element are oxidized by the action of the cupric ions to form cuprous ions, the cupric ions are reduced to cuprous ions, and the cuprous ions from both sources are stabilized by combining with the complexing agent to form the stable, reversible complex ion of the resultant solution.

During etching of the copper element, the copper etching solution is maintained at a temperature in the range of about 0° to about 100° C.

Solution temperatures less than about 0° C are undesirable because etching rates and solubilities of the materials in the solution are sufficiently low to be commercially unattractive. Solution temperatures greater than about 100° C are undesirable because such temperatures cause excessive losses of complexing agent and evaporation of water which results in waste and makes the solutions undesirably difficult to handle.

The contacting of the copper element and copper etching solution can be by passing the etching solution through space and onto the copper element or by immersing the copper element in the etching solution, for example. The period of time that the copper element and the etching solution are maintained in contact with one another is dependent upon the properties of the copper element, the extent to which the element is to be etched, the pressure under which the process is carried out, and other factors which dictate etching time. Once these factors are determined, one skilled in the art can easily determine the optimum etching time to be used.

After the copper etching solution has dissolved sufficient copper to reduce the etching rate to an undesirable rate, then copper metal, cuprous oxide, or mixtures thereof, can be separated and recovered, and the resultant regenerated solution can be reused.

In this regeneration process, the copper etching solution having the cuprous complex resulting from etching the copper element is physically treated for converting at least a part of the cuprous complex back to said cupric compound, said complexing agent of the initial copper etching solution, and insoluble copper material. Thereafter, the insoluble copper material resulting from said treating is separated and the resulting cupric compound and complexing agent are recovered.

This treating of the resultant copper etching solution containing the stable cuprous ion complex is in a manner such that the complexing agent is removed by physical treatment to the extent that the cuprous ion is sufficiently destabilized to form insoluble cuprous oxide or disproportionate into cupric ion and metallic copper.

The treating can be by, for example, heating, passing ultrasonic waves through the resultant solution, boiling said resultant solution to distill off the complexing agent as an azeotrope with water, bubbling an inert gas, such as nitrogen, through said resultant solution, placing said resultant solution under vacuum, extracting said resultant solution with an immiscible solvent, or by a combination of these treatments.

The resulting solution can be treated at atmospheric pressures, elevated pressures, or at pressures less than atmospheric pressures. Where the treating method is by heating, it is preferred that the treating pressure be at a value at, or less than, atmospheric.

During treating of the resultant solution, a solvent such as benzene or chloroform, for example, can be added to the resultant solution to enhance the separation.

In the method of this invention, the copper metal, cuprous oxide, or mixtures thereof, can be separated from the treated solution by, for example, one of centrifuging, filtering, decanting said treated solution, or by a combination of these treatments.

It should be understood that the method of this invention can be conducted as batch processes or continuous processes. The process can also be conducted in a closed or an open system, at atmospheric pressure, or at greater or less than atmospheric pressure. One example would be to etch the copper element in the etching tank and provide equipment to pass the cupric compound and complexing agent resulting from the treating steps into said etching tank for reuse. It should also be understood that the complexing agent can be added either continuously or intermittently to the solution during the etching process.

The following are examples of the composition and processes of this invention:

EXAMPLE I

A 200 ml volume of aqueous cupric sulfamate solution of 3.0 molar concentration was adjusted to pH 1.4 with sulfamic acid. To this was added 12 gm of copper metal turnings. The mixture was stirred at room temperature under a carbon monoxide atmosphere until all the copper metal had dissolved. The carbon monoxide atmosphere was removed, and the solution was heated to 65° C and stirred rapidly. Carbon monoxide evolved from the solution, and bright shiny flakes of metallic copper precipitated.

EXAMPLE II

A 200 ml volume of aqueous cupric sulfate solution of 1.0 molar concentration was adjusted to pH 2.0 with sulfuric acid. To this was added 12 gm of copper metal turnings. The mixture was stirred at room temperature under a carbon monoxide atmosphere until all the copper metal had dissolved. The carbon monoxide atmosphere was removed, and the solution was heated to boiling, causing a rapid evolution of gas and precipitation of bright shiny particles of metallic copper.

EXAMPLE III

A 200 ml volume of aqueous solution containing cupric nitrate at 1.0 molar concentration and allyl alcohol at 2.0 molar concentration was prepared. To this was added 6.3 gm of copper metal turnings. The mixture was placed in a closed container, the pressure was reduced to one-half atmosphere, and the mixture was stirred at room temperature until all the copper metal had dissolved. The container was then opened, the solution was heated to boiling, and water and allyl alcohol were distilled off together as an azeotropic mixture at 89° C. As the distillation proceeded, copper metal flakes precipitated.

EXAMPLE IV

A 200 ml volume of aqueous solution containing cupric sulfate at 0.5 molar concentration and allyl alcohol at 1.0 molar concentration was prepared. To this was added 6.3 gm of copper metal turnings. The mixture was stirred at room temperature until all the copper had dissolved. The solution was heated to boiling, and water and allyl alcohol were distilled off together as an azeotropic mixture at 89° C. As the distillation proceeded, fine copper metal powder precipitated. An X-ray diffraction measurement of the powder indicated that a small amount of cuprous oxide had coprecipitated with the copper metal.

EXAMPLE V

A 200 ml volume of aqueous cupric sulfamate solution of 2.0 molar concentration was adjusted to pH 2.2 with sulfamic acid. To this was added 3.2 gm of copper metal turnings. The mixture was stirred at room temperature under an ethylene atmosphere until most of the copper metal had dissolved. The solution was filtered, and the filtrate was heated at a reduced pressure of about one-half atmosphere. Ethylene evolved from the solution and bright shiny particles of metallic copper precipitated.

EXAMPLE VI

A 200 ml volume of aqueous cupric nitrate solution of 3.0 molar concentration was adjusted to pH 1.8 with nitric acid. To this was added 3.2 gm of copper metal turnings and 0.1 gm of sodium lauryl sulfate. The mixture was stirred at room temperature under a carbon monoxide atmosphere until most of the copper had dissolved. The mixture was filtered, and the filtrate was heated under a vacuum of one-half atmosphere. Carbon monoxide evolved from the solution and bright shiny particles of copper metal precipitated.

EXAMPLE VII

A 400 ml volume of aqueous solution containing cupric sulfate at 0.5 molar concentration and allyl alcohol at 0.25 molar concentration was prepared and adjusted to pH 3.0 with concentrated sulfuric acid. To this was added 6.4 gm of copper metal turnings. The mixture was stirred at room temperature under carbon monoxide at about 0.25 psi pressure above atmospheric until all the copper metal had dissolved. The clear solution was placed under a vacuum of one-half atmosphere and ultrasonic waves were passed into it. A rapid evolution of carbon monoxide occurred, and fine shiny particles of copper metal precipitated.

EXAMPLE VIII

A 200 ml volume of aqueous solution containing cupric formate at 0.5 molar concentration and allyl alcohol at 0.5 molar concentration was prepared. The solution was adjusted to pH 3.5 with formic acid. To this was added 3.2 gm of copper metal turnings. The stoppered mixture was stirred rapidly at 50° C until all the copper metal had dissolved. When the stopper was removed and some of the allyl alcohol was allowed to evaporate, bright metallic copper began to precipitate.

EXAMPLE IX

A 200 ml volume of aqueous cupric sulfate solution of 0.5 molar concentration was adjusted to pH 3.0 with concentrated sulfuric acid. To this was added 3.2 gm of copper metal turnings. The mixture was stirred rapidly at room temperature under a propylene atmosphere until about half the copper had dissolved. The stirrings was stopped, the clear supernatant solution was decanted into another container, and heated. Propylene evolved rapidly and fine particles of copper metal precipitated.

EXAMPLE X

A 200 ml volume of aqueous solution containing cupric fluosilicate at 0.5 molar concentration and allyl alcohol at 0.5 molar concentration was prepared. It was adjusted to pH 1.3 with 25% fluosilicic acid. To this was added 3.2 gm of copper metal turnings. The mixture was stirred at 50° C until the copper had dissolved. The clear solution was boiled to distill off the water-allyl alcohol azeotrope as in Example III. As the distillation proceeded, copper metal particles precipitated.

EXAMPLE XI

A 200 ml volume of aqueous solution containing cupric acetate at 0.5 molar concentration and allyl alcohol at 0.5 molar concentration was prepared. The pH of the solution was 4.8. To this was added 3.2 gm of copper metal turnings. The mixture was stirred at 50° C until about half the copper had dissolved. The mixture was filtered, and the clear filtrate was boiled under a vacuum of about one-half atmosphere. As the allyl alcohol and water boiled off, copper metal particles precipitated.

EXAMPLE XII

A 3500 ml volume of aqueous solution containing cupric sulfate at 0.5 molar concentration and allyl alcohol at 0.5 molar concentration was adjusted to pH 3.0 with concentrated sulfuric acid. This solution at room temperature was sprayed at 4 psi pressure through a nozzle onto a 3 × 5 inch polyester glass laminate to which was bonded copper foil 0.0014 inch thick. Spraying was continued until all copper had been dissolved. The solution was then heated to boiling, and water and allyl alcohol were co-distilled as an azeotrope as in Example III. As the distillation proceeded, shiny flakes of copper metal precipitated.

EXAMPLE XIII

A 3500 ml volume cupric sulfamate solution of 2.0 molar concentration was adjusted to pH 2.0 with sulfamic acid. In a carbon monoxide atmosphere, at room temperature, the solution was sprayed at 4 psi through a nozzle onto a 3 × 5 inch polyester glass copper laminate as in Example XII. Carbon monoxide was introduced into the liquid stream within the nozzle so that there was intimate mixing of the gas and liquid. Spraying was continued until all copper had been dissolved. The solution was then placed under a vacuum of one-half atmosphere. Evolution of carbon monoxide occurred and particles of copper metal precipitated.

EXAMPLE XIV

A 200 ml volume of aqueous solution containing cupric nitrate at 1.0 molar concentration and allyl alcohol at 1.0 molar concentration was adjusted to pH 3.0 with concentrated nitric acid. To this was added 3.2 gm of copper metal turnings. The mixture was stirred at room temperature until all the copper had dissolved. Then 100 ml of toluene was added to the clear solution. The resulting mixture formed two distinct liquid phases. The mixture was boiled with stirring, and a ternary azeotrope of water, allyl alcohol and toluene was allowed to distill off. As the distillation proceeded, shiny particles of copper metal precipitated.

EXAMPLE XV

A 200 ml volume of aqueous solution containing cupric nitrate at 1.0 molar concentration and crotyl alcohol at 1.0 molar concentration was adjusted to pH 3.0 with concentrated sulfuric acid. To this was added 3.2 gm of copper metal turnings. The mixture was stirred at room temperature until all the copper had dissolved. The clear solution was heated to boiling, and water and crotyl alcohol distilled off together at 93.5° C. As the distillation proceeded, copper metal flakes precipitated.

Other modifications and alterations of this invention will become apparent to those skilled in the art from the foregoing discussion, and it should be understood that this invention is not to be unduly limited thereto.

What is claimed is:

1. A copper etching process, comprising:

contacting a copper element to be etched with an aqueous etching solution, said copper etching solution comprising a cupric compound and a complexing agent, said cupric compound being water soluble and substantially free of anions capable of forming a stable complex ion with cuprous ions in said solution and said complexing agent being a material capable of forming a stable complex ion with cuprous ions and being substantially free of material capable of forming a complex ion with cupric ion; and maintaining the copper element in contact with said etching solution under etching conditions for a time sufficient to etch said copper element and form a cuprous complex ion.

2. A process, as set forth in claim 1, including maintaining the etching solution at a temperature in the range of about 0° C to about 100° C during etching of the copper element.

3. A process, as set forth in claim 1, including maintaining the pH of the etching solution in a pH range of about 0 to about 7 during etching of the copper element.

4. A process, as set forth in claim 1, including adding one of sulfuric acid, nitric acid, fluosilicic acid, acetic acid, formic acid, sulfamic acid, or mixtures thereof, to the etching solution for maintaining the pH of the etching solution in a preselected range.

5. A process, as set forth in claim 1, wherein the concentration of the cupric compound of the etching solution is in the range of about 0.1 to about 5.0 molar.

6. A process, as set forth in claim 1, wherein the etching solution includes a wetting agent.

7. A process, as set forth in claim 1, wherein the cupric compound of the etching solution is one of cupric sulphate, cupric nitrate, cupric sulfamate, cupric fluosilicate, cupric acetate, cupric formate, or mixtures thereof.

8. A process, as set forth in claim 1, wherein the complexing agent is one of carbon monoxide, ethylene, derivatives of ethylene having the formula

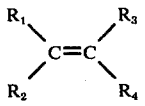

where $R_1$, $R_2$ and $R_3$ are each one of hydrogen or methyl, and $R_4$ is a member of the group consisting of H, $-CH_2OH$, $-CH(C_2H_5)OH$, $-CH(CH_3)OH$, $-C(CH_3)_2OH$, $-CH_2CH_2OH$, $-CH_2CH(CH_3)OH$, and $-CH_2C(CH_3)_2OH$, or mixtures thereof.

9. A process, as set forth in claim 1, wherein the etching solution is passed through space and onto the copper element.

10. A process, as set forth in claim 1, wherein the copper element is immersed in the copper etching solution.

11. A process, as set forth in claim 1, including adding complexing agent to the solution during etching of the copper element.

12. A process, as set forth in claim 1, including maintaining the pressure at greater than atmospheric.

13. A process, as set forth in claim 1, including maintaining the pressure at less than atmospheric.

14. A process, as set forth in claim 1, including physically treating the resultant copper etching solution having said cuprous complex and converting the cuprous complex to said cupric compound and said complexing agent; thereafter separating at least one of copper metal, cuprous oxide, or a mixture thereof, from the resultant solution; and recovering the resultant cupric compound and complexing agent.

15. A process, as set forth in claim 14, wherein the resultant copper etching solution is physically treated by at least one of heating said resultant solution, passing ultrasonic waves through said resultant solution, or at least partially distilling said resultant solution.

16. A process, as set forth in claim 14 wherein the resultant copper etching solution is treated by adding a solvent.

17. A process, as set forth in claim 14, wherein the copper material is separated from said treated solution by at least one of centrifuging, filtering, or decanting said resultant solution.

18. A process, as set forth in claim 14, including etching the copper element in an etching tank and passing the recovered resultant cupric compound and complexing agent to said etching tank.

19. An aqueous copper etching solution comprising water, a cupric compound, and a complexing agent, said cupric compound being water soluble and substantially free of anions capable of forming a stable complex ion with cuprous ions in said solution and said complexing agent being of a material capable of forming a stable complex ion with cuprous ions and being substantially free of material capable of forming a complex ion with cupric ion.

20. An aqueous copper etching solution, as set forth in claim 19, wherein said complexing agent is one of carbon monoxide, ethylene, derivatives of ethylene having the formula

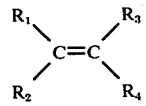

where $R_1$, $R_2$, and $R_3$ are each one of hydrogen or methyl, and $R_4$ is a member of the group consisting of H, $-CH_2OH$, $-CH(C_2H_5)OH$, $-CH(CH_3)OH$, $-C(CH_3)_2OH$, $-CH_2CH_2OH$, $-CH_2CH(CH_3)OH$, and $-CH_2C(CH_3)_2OH$, or mixtures thereof.

21. An aqueous copper etching solution, as set forth in claim 19, wherein the cupric compound is one of cupric sulphate, cupric sulfamate, cupric nitrate, cupric fluosilicate, cupric acetate, cupric formate, or mixtures thereof.

22. An aqueous copper etching solution, as set forth in claim 21, wherein said complexing agent is one of carbon monoxide, ethylene, derivatives of ethylene having the formula

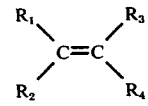

where $R_1$, $R_2$, and $R_3$ are each one of hydrogen or methyl, and $R_4$ is a member of the group consisting of H, $-CH_2OH$, $-CH(C_2H_5)OH$, $-CH(CH_3)OH$, $-C(CH_3)_2OH$, $-CH_2CH_2OH$, $-CH_2CH(CH_3)OH$, and $-CH_2C(CH_3)_2OH$, or mixtures thereof.

23. An aqueous copper etching solution, as set forth in claim 19, wherein said etching solution includes a wetting agent.

24. An aqueous copper etching solution, as set forth in claim 19, wherein said etching solution has a cupric compound concentration in the range of about 0.1 to about 5.0 molar.

25. An aqueous copper etching solution, as set forth in claim 19, wherein said etching solution has a pH in the range of about 0 to about 7.

* * * * *